US006558300B2

(12) United States Patent
Deola

(10) Patent No.: US 6,558,300 B2
(45) Date of Patent: May 6, 2003

(54) WEIGHT STACK FOR EXERCISE MACHINE

(76) Inventor: James A. Deola, 2584 Lincoln Ave., Vineland, NJ (US) 08361

( * ) Notice: Subject to any disclaimer, the term of this patent is extended or adjusted under 35 U.S.C. 154(b) by 57 days.

(21) Appl. No.: 09/892,714

(22) Filed: Jun. 27, 2001

(65) Prior Publication Data

US 2003/0004039 A1 Jan. 2, 2003

(51) Int. Cl.[7] ..... A63B 21/062
(52) U.S. Cl. ..... 482/99; 482/102
(58) Field of Search ..... 482/93, 94, 98–103

(56) References Cited

U.S. PATENT DOCUMENTS 4,648,594 A * 3/1987 Schleffendorf ..... 482/102
4,784,384 A * 11/1988 Deola ..... 482/99
4,856,773 A * 8/1989 Deola ..... 482/102
D359,326 S * 6/1995 Deola ..... D21/675
5,921,904 A 7/1999 Toups
6,102,835 A 8/2000 Webber
6,146,316 A * 11/2000 Carolus et al. ..... 482/98
6,193,635 B1 2/2001 Webber et al.
6,238,323 B1 5/2001 Simonson
6,443,877 B1 * 9/2002 Hoecht et al. ..... 482/103

* cited by examiner

*Primary Examiner*—Stephen R. Crow
*Assistant Examiner*—Victor K. Hwang
(74) *Attorney, Agent, or Firm*—Norman E. Lehrer

(57) ABSTRACT

A weight stack apparatus for an exercising machine includes a weight stack comprised of a plurality of weights vertically arranged on top of each other with each of said weights including a pair of spaced apart substantially vertical apertures extending therethrough. A pair of spaced apart substantially vertically extending guide rods pass through the weights as they are moved up and down. At least one of the guide rods is hollow. An upper pulley is mounted adjacent the upper end of the hollow guide rod and a cable passes over the upper pulley. A first end of the cable extends downwardly toward the weight stack and includes means for selectively connecting any desired number of the weights to the first end of the cable. A second end of the cable extends downwardly through the hollow guide rod and around a lower pulley mounted adjacent the lower end of the hollow guide rod and is connected to the exercising machine.

7 Claims, 2 Drawing Sheets

WEIGHT STACK FOR EXERCISE MACHINE

BACKGROUND OF THE INVENTION

The present invention is directed toward a weight stack for an exercise machine and more particularly toward a weight stack which is intended to be self-supporting and does not require additional equipment or a wall or the like for supporting the same in a vertical orientation.

Conventional weight stacks are normally comprised of a stack of brick-like weights vertically arranged on top of each other with a pair of vertically extending guide rods extending through the weights. The top of the weight stack is linked to a cable and pulley system which connects the stack to various exercise devices or stations. Each weight normally has an opening accessible to the user and a pull pin is inserted into a selected opening to determine how many weights in the stack are to be lifted along the guide rods when a user performs an exercise.

The design of most weight stacks for exercise machines includes the cable extending over the upper pulley extending from the same at an angle away from the weight stack. Accordingly, when a force is applied to the free end of the cable such as may be necessary to utilize the weight stack for performing an exercise, a horizontal force is applied to the top of the guide rods forming part of the weight stack. In order to prevent the same from tipping, the weight stack must, therefore, either be attached to a wall or must include some additional supporting members for preventing the same from tipping.

With respect to most multi-station exercise machines currently on the market, the foregoing is not a significant problem since there are normally numerous support rods and structures that make up the multi-station exercise equipment. Some of these can be used to help support the weight stack and prevent the same from tilting.

There may, however, be instances where a weight stack is needed and where there is no other structural support available for preventing the stack from tipping. This could be accomplished utilizing a conventional weight stack by simply having the free end of the cable extend straight vertically downwardly so that the force on the pulley and the guide rods is vertically downward. The free end of the cable can then extend around additional pulleys mounted at the floor level to then be connected to an exercise device.

This, however, creates the additional problem of requiring an additional support structure at the top of the weight stack that would have to extend away from the weight stack thereby increasing the space taken up by the weight stack. In addition, unless additional housings or enclosures are utilized, the freely moving cable would be exposed thereby possibly creating a risk of injury.

SUMMARY OF THE INVENTION

The present invention is designed to overcome the deficiencies of the prior art discussed above by utilizing one of the guide rods as the return for the cable. According to the invention, a weight stack apparatus for an exercising machine includes a weight stack comprised of a plurality of weights vertically arranged on top of each other with each of said weights including a pair of spaced apart substantially vertical apertures extending therethrough. A pair of spaced apart substantially vertically extending guide rods pass through the weights as they are moved up and down. At least one of the guide rods is hollow. An upper pulley is mounted adjacent the upper end of the hollow guide rod and a cable passes over the upper pulley. A first end of the cable extends downwardly toward the weight stack and includes means for selectively connecting any desired number of the weights to the first end of the cable. A second end of the cable extends downwardly through the hollow guide rod and around a lower pulley mounted adjacent the lower end of the hollow guide rod and is connected to the exercising machine.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
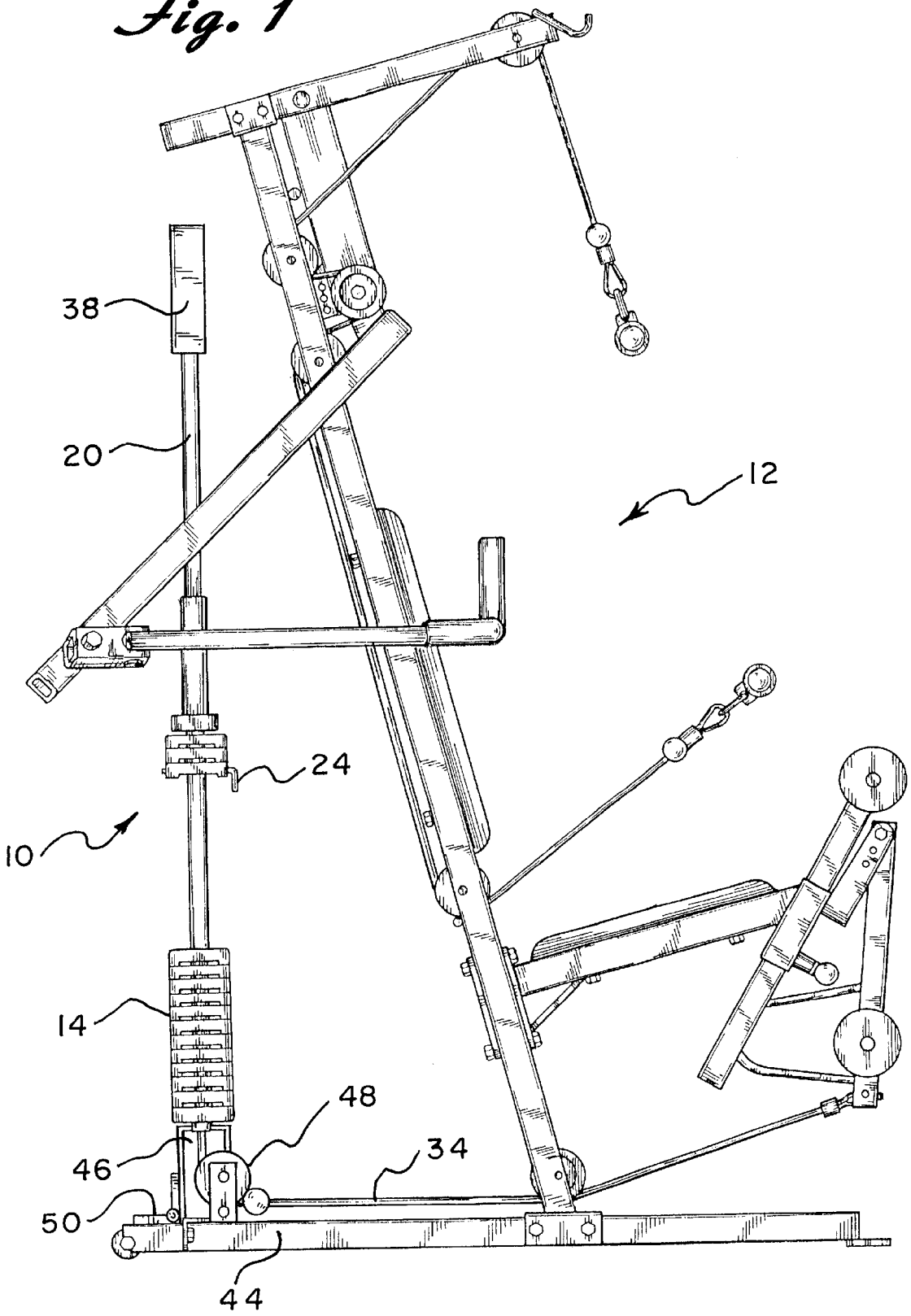
FIG. 1 is a side elevational view of a weight stack constructed in accordance with the principles of the present invention and shown in combination with an exercise machine.
Figure 2:
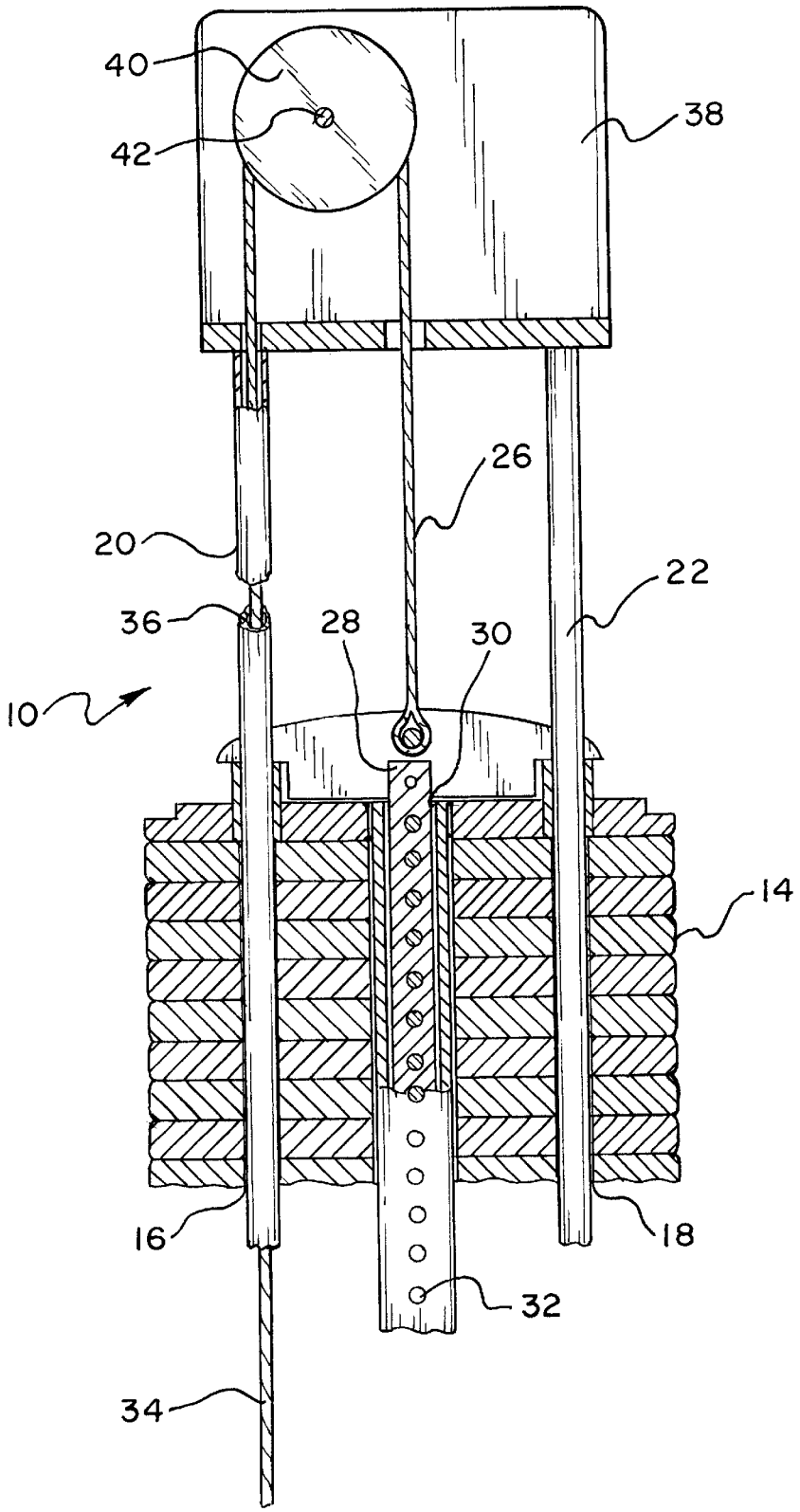
FIG. 2 is a front elevational view shown partly in cross-section of the upper portion of the weight stack shown in FIG. 1 with portions broken away for clarity.

Referring now to the drawings in detail wherein like reference numerals have been used in both of the figures to designate like elements, there is shown in FIGS. 1 and 2 a weight stack constructed in accordance with the principles of the present invention and designated generally as 10. As shown in FIG. 1, the weight stack 10 can be used with or incorporated into an exercise machine 12. The exercise machine 12 shown in FIG. 1 is similar to that shown in Design Pat. No. Des. 359,326 and the details thereof, therefore, will not be described herein. This is, however, by way of example only as the weight stack 10 of the present invention could be used in combination with substantially any type of exercise machine that requires a resistance force or could be sold as a stand alone unit to be combined by the consumer with substantially any type of exercise machine.

The weight stack 10 of the invention is, for the most part, constructed in substantially the same manner as a conventional weight stack. That is, it includes a plurality of weights 14 vertically arranged on top of each other. Each of the weights 14 includes a pair of spaced apart substantially vertical apertures 16 and 18 (FIG. 2) extending therethrough. First and second (or left and right) spaced apart substantially vertically extending guide rods 20 and 22 pass through the apertures 16 and 18 and guide the weights 14 as they are moved up and down.

The amount of weight to be lifted depends, of course, on the number of weights 14 that are moved. As is known in the art, the amount of weight desired or selected is determined by the position of the pull pin 24. Extending downwardly from above toward the stack of weights 14 is a cable 26. Connected to the lower most end of the cable 26 is an elongated rod or bar 28 that passes down through the vertical opening 30 that is centrally located in each of the weights 14. A horizontally extending aperture (not shown) is formed through the front face of each of the weights 14 and intersects one of the openings 32 in the bar 28. When the pin 24 is inserted into one of the weights 14, that weight becomes the bottom most weight and when the cable 26 is pulled upwardly, the selected weight 14 and all of the weights above it are lifted. All of the foregoing is well known in the prior art and does not, per se, form part of the inventive concept of the present invention.

As is also well known in the art, the cable such as cable 26 that extends downwardly from above to be connected to the weights 14 is normally passed over an upper pulley secured to some structure mounted overhead and then passes downwardly normally at some angle to the vertical to be connected to the exercising machine to provide a resistance force. In such prior art weight stacks, the guide rods normally provide no other function other than to guide the weights 14 as they move up and down. The present invention differs from prior systems in this regard.

As shown most clearly in FIG. 2, the first guide rod 20 is hollow and the second end 34 of the cable passes downwardly through the center opening 36 thereof. A bracket or frame member 38 secures the upper ends of the guide rods 20 and 22 together and an upper pulley 40 secured to the frame member 38 at pivot 42 guides the cable from the plurality of weights 14 down and into the interior 36 of the guide rod 20.

As best seen in FIG. 1, the bottom of the guide rod 20 is mounted slightly above the top of a base 44 through the use of a bracket 46. This provides room for a lower pulley 48 which is also mounted on the base 44 and around which passes the lower end 34 of the cable wherein it continues on to be connected to the exercise machine 12. Preferably, hinges such as shown at 50 are used to mount the bracket 46 to the base 44 so that the guide rods and the weight stack can be moved from their upright working position as shown in FIG. 1 to a lowered position for storage.

While not necessary to practice the principal aspects of the present invention, the second guide rod 22 may also be hollow. However, it could also be a conventional solid guide rod. The lower end of the second guide rod 22 may, therefore, be connected to the base 44 in any conventional manner known in the art but is preferably hinged thereto as described above.

The present invention may be embodied in other specific forms without departing from the spirit or essential attributes thereof and accordingly, reference should be made to the appended claims rather than to the foregoing specification as indicating the scope of the invention.

I claim:

1. In a weight stack apparatus for an exercising machine including a weight stack comprised of a plurality of weights vertically arranged on top of each other with each of said weights including a pair of spaced apart substantially vertical apertures extending therethrough and first and second spaced apart substantially vertically extending guide rods, said guide rods passing through said vertical apertures for guiding said weights as they are moved up and down, said apparatus further including an upper pulley mounted adjacent the upper end of said guide rods and a cable passing over said upper pulley, a first end of said cable extending downwardly toward said weight stack and including means for selectively connecting any number of said plurality of weights to said first end of said cable and a second end of said cable extending downwardly to be connected to said exercising machine wherein the improvement comprises said first guide rod being hollow and said second end of said cable passing through the interior of said first guide rod.

2. The improvement as claimed in claim 1 wherein said upper pulley is secured to the upper end of said first guide rod.

3. The improvement as claimed in claim 2 further including a frame member securing the upper ends of said first and second guide rods together and wherein said upper pulley is supported by said frame member.

4. The improvement as claimed in claim 1 further including a lower pulley adjacent the lower end of said first guide rod, said second end of said cable passing around said lower pulley.

5. The improvement as claimed in claim 4 wherein said lower pulley is secured to the lower end of said first guide rod.

6. The improvement as claimed in claim 1 further including a base supporting said guide rods.

7. The improvement as claimed in claim 6 wherein said guide rods are pivotably mounted to said base so as to be movable between an upright working position and a lowered storage position.

* * * * *